United States Patent [19]

Legrand et al.

[11] Patent Number: 4,872,716

[45] Date of Patent: Oct. 10, 1989

[54] CASEMENT LOCK, NOTABLY OF THE TYPE COMPRISING A PLURALITY OF OPERATING RODS WITH RESILIENT RETURN MEANS

[75] Jean-Claude Legrand, Reding; Prevot Géfard, Willerwald, both of France

[73] Assignee: Ferco International, Sarrebourg, France

[21] Appl. No.: 201,875

[22] Filed: Jun. 3, 1988

[30] Foreign Application Priority Data

Jun. 11, 1987 [FR] France ..... 87.08316

[51] Int. Cl.[4] ..... E05C 9/02

[52] U.S. Cl. ..... 292/336.3; 292/33

[58] Field of Search ..... 292/336.3, 144, 201, 292/21, 92, DIG. 62, DIG. 56, 33; 70/463

[56] References Cited

U.S. PATENT DOCUMENTS

| | | | |
|---|---|---|---|
| 1,521,835 | 1/1925 | Reed | 292/DIG. 56 X |
| 1,688,472 | 10/1928 | Shaw | 70/463 X |
| 1,764,154 | 6/1930 | Cramer | 70/463 X |
| 2,030,630 | 2/1936 | Gram | 292/DIG. 56 X |
| 2,098,776 | 11/1937 | Edwards | 70/463 X |

*Primary Examiner*—Richard E. Moore

*Attorney, Agent, or Firm*—Sandler & Greenblum

[57] ABSTRACT

This casement lock (1), notably for casement doors, French windows or the like, comprises essentially a casing (2) enclosing a mechanism for actuating a half-turn bolt, and one or a plurality of operating rods (5, 6) urged to their locking position by resilient means (9). This casement lock is further provided with damping means (14) for slowing down the operating rods (5, 6) during their return movement to the locking position under the action of the resilient means (9).

8 Claims, 1 Drawing Sheet

CASEMENT LOCK, NOTABLY OF THE TYPE COMPRISING A PLURALITY OF OPERATING RODS WITH RESILIENT RETURN MEANS

BACKGROUND OF THE INVENTION

1. Field Of The Invention

This invention relates to casement locks and more particularly to a casement lock for doors, French windows or the like, which comprises essentially a casing enclosing a mechanism for actuating a half-turn bolt and one or a plurality of operating rods provided with at least one locking member, a bolt for holding the operating rods in an inoperative position and release means fixed to the window frame and adapted, when closing the casing door or window, to engage the holding bolt and thus enable the resilient means to return the operating rods to their locking position.

2. The Prior Art

A casement lock having the above-mentioned features is already known in the art. Thus, this known casement lock comprises a casing enclosing a number of component elements of the mechanism controlling the movements of one or a plurality of operating rods and a half-turn bolt. As a rule, these operating rods are provided with one or a plurality of locking members or bolts engageable in keepers fixed to the frame or dormant of the door, French window or the like. Moreover, this casement lock comprises resilient means, notably in the form of spiral springs, constantly urging the operating rods to their locking position without requiring any actuation of the handle-bar. However, a primary requirement in casement locks of this type is that this return movement of the operating rods takes place only during the closing movement of the casement door or window.

For this purpose, the casement lock further comprises a locking member adapted to hold the operating rods in a release position. This locking member becomes operative when the handle-bar is turned to open the door, French window or the like. In contrast thereto,when closing the door or window, release means fixed to the door or window frame cooperate with this locking member to release the operating rods which are then returned instantaneously to their locking position by the abovementioned spiral spring.

It is also known in the art to use resilient means for returning automatically the operating rods of a casement bolt to their release position. Thus, to hold said rods in their release position the casement lock is provided with locking means comprising a stud projecting from the visible surface of the top rail. During the closing movement of the door or window, this stud is pushed inwards and releases the locking means. As a result, the operating rods are urged instantaneously to their locking position. In contrast to the first casement lock construction mentioned hereinabove, the operating rods in this prior arrangement are moved in opposite directions and the resilient means consist of coil compression springs.

By reason of the resilient means urging the operating rods, most hitherto known casement locks display an advantageous feature consisting in the quick response of the mechanism when locking a door, French window or the like. This feature is inasmuch advantageous in that the door or window is locked simultaneously at several points without requiring any intervention from the user. However, this type of casement lock is also attended by a number of far from negligible inconveniences.

In fact, when closing a door, French window or the like, the release means fixed to the dormant or frame cooperate with the locking member associated with the operating rods so as to release these rods. At the end of their stroke, these operating rods or their locking members abute a stop member, usually of metal, and this shock produces a noise of relatively high intensity. The magnitude of the noise caused by the casement lock during the closing movement of the door or window increases with the gradual aging of the mechanism. This noise may prove particularly unpleasant in certain circumstances, notably in the case of collective or appartment houses.

SUMMARY OF THE INVENTION

It is the primary object of the present invention to avoid this inconvenience by providing a casement lock for a door, French window or the like, this casement lock comprising essentially a casing enclosing a mechanism for actuating a half-turn bolt and one or a plurality of operating rods provided with at least one locking member, a member for holding said operating rods in their release position and release means on the fixed frame of the door or window which are adapted, when closing the door or window, to cooperate with the holding member for returning the operating rods to their locking position under the action of resilient means, said casement lock being provided with damping means for retarding the movement of the operating rods from their release to their locking position under the action of said resilient means.

The advantages characterising the casement lock according to the present invention lie essentially in the fact that the damping means incorporated therein permit the reduction, by resilient means, of the velocity of movement of the operating rods while preserving the stiffness coefficient of said resilient means. In fact, the resilient means contemplated must necessarily have a permanent strength sufficient for overcoming the resistance likely to be encountered by the locking members during their penetration into the corresponding striker plates or keepers.

Another advantageous feature of the present invention results from the particularly reduced overall dimensions of the damping means so that the assembly can be housed in a casing of standard dimensions.

BRIEF DESCCIPTION OF THE DRAWING

FIG. 1 is an elevational, part-sectional view of the casement lock according to the instant invention, and FIG. 2 is a diagrammatic section taken along the line II—II of FIG. 1.

DESCRIPTION OF THE PREFERRED EMBODIMENT

Figure 1:
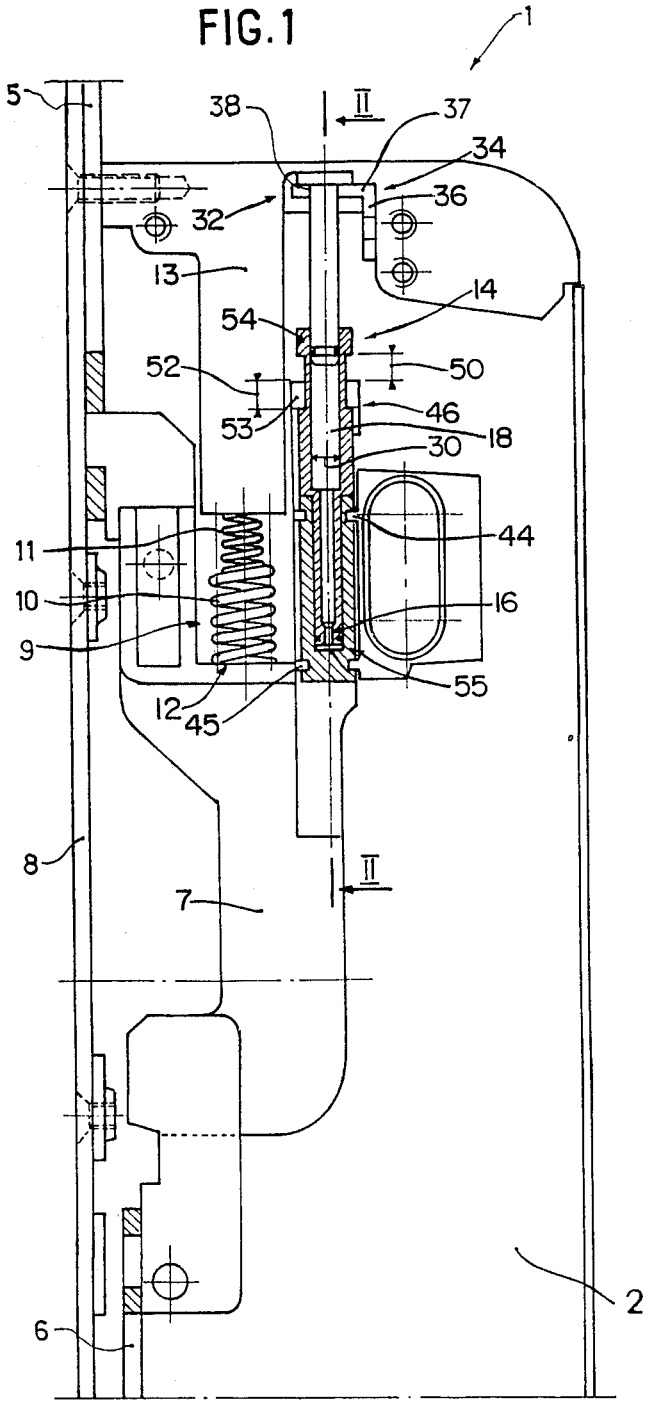
Figure 2:
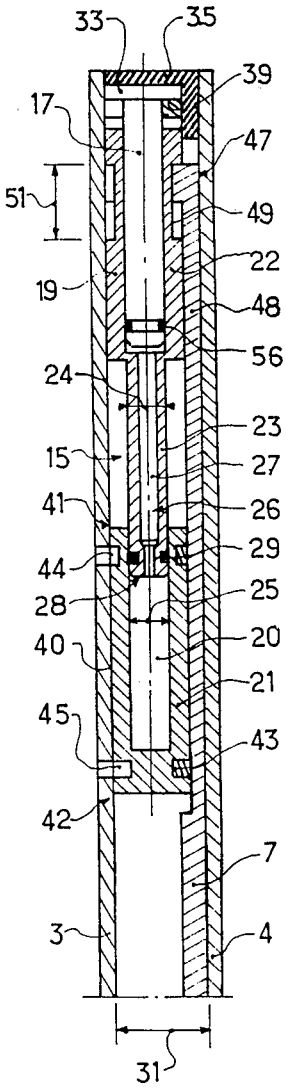

The casement lock 1 illustrated in the drawing comprises essentially a casing 2 consisting of two parallel plates 3, 4 enclosing a mechanism (not shown) for actuating on the one hand a half-turn bolt and, on the other hand, one or a plurality of operating rods 5, 6.

In the casement lock illustrated in FIG. 1 the operating rods 5, 6 are coupled by means of a connecting member 7 so that they both perform exactly the same movements when actuated. However, the casement lock may if desired be provided with a suitable and known mechanism for moving the operating rods 5, 6 in opposite directions, without departing from the basic principles of the invention.

The pair of operating rods 5, 6 are slidably mounted behind a face plate 8 and comprise one or several bolts (not shown) adapted to engage corresponding keepers disposed on the edge of the fixed frame. The casement lock 1 is advantageously provided with resilient means 9 engaging the connecting member 7 for urging the operating rods 5, 6 to their locking position. The resilient means 9 illustrated in Figure 1 comprise a pair of concentric coil compression springs 10, 11 bearing with their bottom ends 12 against a horizontal portion of connecting member 7 and having their top ends engaged in a cavity formed in an inner projection 13 of casing 2. With this particular arrangement the coil springs 10, 11 constantly urge the operating rods 5, 6 downwards, that is, to their locking position.

However, it will be seen that the casement lock 1 according to the present invention is not limited to this specific configuration of resilient means 9. Thus, a spiral spring of the type disclosed in the prior art mentioned hereinabove may be substituted for the coil springs 10, 11. Furthermore, it is also possible to modify the arrangement of the resilient means 9 so that they engage directly one of the rods 5, 6.

Due to the presence of the resilient means 9, the casement lock 1 should preferably be provided with a locking member (not shown) capable of holding the operating rods 5, 6 in their release position when opening the door, French window or the like. When closing the door or window panel, this locking member would engage release means fixed to the dormant of the door or winrow, so as to release the operating rods 5, 6 and return them to their locking position.

According to the present invention, the casement lock 1 also comprises damping means 14 for retarding or slowing down the movement of the operating rods 5, 6 when they return to their locking position under the pressure of the resilient means 9. Thus, by reducing the speed of this movement performed by the operating rods 5, 6, the noise produced by the casement lock 1 will be reduced considerably.

According to a preferred form of embodiment of the invention, the damping means 14 consist of a double-acting shock absorber 15 operating on the well-known principle of the inertia effect produced by causing a fluid to flow through a throttling orifice or passage 16. This shock absorber 15 is secured to the casing 2 of the casement lock 1 and is operatively connected to the operating rods 5, 6.

According to the present invention, in the construction of the casement lock 1 shown in FIG. 1 the operating rods 5, 6 are connected to the shock absorber 15 through the connecting member 7. However, at the cost of minor changes in the configuration and arrangement of the operating rods 5, 6, it is possible to couple directly said shock absorber 15 to one of said rods, notably in the case of operating rods moving in opposite directions. It will be seen that these changes are obviously within the understanding and skill of the art.

According to a preferred form of embodiment, the shock absorber 15 consists of a fixed piston 17 slidably mounted in a central bore 18 of a movable piston 19 adapted to slide in another bore 20 formed in a cylindrical body 21. The fixed piston 17 and the cylindrical body 21 are secured to the casing 2 of casement lock 1. In contrast thereto, the movable piston 19 is coupled via the connecting member 7 to the operating rods 5, 6.

According to a specific feature of the present invention, this movable piston 19 has a particular configuration and comprises two axially aligned portions 22, 23, the upper portion 22 comprising the central cavity 18 in which the fixed piston 17 is slidably mounted, and the lower portion 23 is slidably mounted in the bore 20 of cylindrical body 21, For this purpose, it will be seen that the outer diameter 24 of the lower portion 23 of movable piston 19 is slightly smaller than the inner diameter 25 of bore 20. Similarly, to permit the relative sliding movement of the fixed piston 17 in the central bore 18 of movable piston 19, the diameters of these two pistons should preferably be calculated accordingly.

Since the shock absorber 15 operates on the principle of the inertia of a fluid flowing through a throttling passage or orifice, the lower portion 23 of movable piston 19 further comprises means 26 permitting the communication between the central bore 18 and the bore 20 of cylindrical body 21, and therefore the flow of a fluid contained in said bores.

Also preferably, the communication means 26 consist of a complementary bore 27 machined in the lower portion 23 of the movable piston 19. This bore 27 opens on the one hand into the central bore 18 of the movable piston 19 and on the other hand into the bore 20 of the cylindrical body 21. The diameter of this complemental bore 27 must be so calculated that this bore will act by itself as the throttling means 16 through which the fluid is caused to flow. However, to facilitate the machining thereof, the diameter of this bore 27 is somewhat greater and comprises at its lower end 28 opening into the bore 20 of the cylindrical body 21 a peripheral shoulder 29 constituting said throttling means 16.

The diameter of the throttling passage 16 is calculated as a function of the viscosity of the fluid utilized and also of the degree of damping force to be attained. This damping force is subordinate to two factors, namely the necessity of reducing the noise generated during the actuation of the casement lock 1, and the effort to be exerted by the user on the handle-bar. Apparently, these two factors appear to be contradictory, but in fact it is obvious that the velocity of movement of the operating rods 5, 6 during the actuation of the handle-bar is definitely lower than the velocity of said rods when they are returned by said resilient means to their locking position. For this reason, it is possible to devise a shock absorber 15 offering a very moderate resistance when actuated by the handle-bar while performing its essential function consisting in slowing down the movements of the operating rods 5, 6 when closing the door, French window or the like.

Under no circumstance should the shock absorber be required or allowed to act as a spring. Therefore, it is a primary requirement that the up- or downward stroke of the movable piston 19 causes a substantially constant amount of fluid to flow from the upper bore 18 to the lower bore 20. This result is obtained when the diameter 25 of bore 20 is equal to the diameter 30 of bore 18.

The stroke of movable piston 19 depends on the one hand on the depth of the central cavity 18 and of the bore 20, and on the other hand on the length of the fixed piston 17 and of the lower portion 23 of the movable piston 19. Preferably, this stroke is slightly greater than the length of the movements performed by the operating rods 5, 6.

The chief advantage resulting from the use of a shock absorber 15 according to the instant invention lies essentially in a substantial reduction of its overall dimensions. This feature is inasmuch advantageous as it is advisable to adhere to standard dimensions for the casing 2 and casement lock 1. More particularly, it is necessary that this shock absorber 15 can be inserted between the two parallel plates 3, 4 having a predetermined relative spacing 31.

In the foregoing, it is stated that the fixed piston 17 and the cylindrical body 21 are rigidly secured to the casing 2. For this purpose, the fixed piston 17 comprises at its upper end 32 a flange 33 cooperating on the one hand with gripping means 34 fixed to the casing 2 and on the other hand with the top wall 35 of the casing. More particularly, the gripping means 34 consist of an angle member comprising a vertical flange 26 and a horizontal flange 37. The horizontal flange 37 has a notch 38 formed therein which has a width slightly greater than the diameter of the fixed piston 17 engaging said notch 38. Thus, the top surface of the horizontal flange 37 engages the shoulder 39 formed by the flange 33 and prevents any downward movement of said fixed piston 17. Besides, due to the very small distance left between the top surface of said horizontal flange 37 and the inner surface of the top wall 35 of casing 2, the fixed piston 17 is also held against movement in a vertical and upward direction.

The outer surface 40 and the ends 41, 42 of the cylindrical body 21 have peripheral grooves 4 formed therein which cooperate with the holding means 44, 45 of casing 2 and casement lock 1.

The movable piston 19 and operating rods 5, 6 are interconnected by gripping means 46 disposed at the upper end 47 of a vertical flange 48 fixed to the connecting member 7. These gripping means 46 engage a peripheral groove 49 machined in the outer surface of the upper portion 22 of movable piston 19.

With this arrangement, when the operating rods 5, 6 are moved by resilient means to their locking position, the rods 5, 6 drive the movable piston 19 via the connecting member 7. Thus, due to the inertia of the fluid flowing through the throttling passage 16, the movement of the operating rods 5, 6 can only take place at a low speed and consequently the noise resulting from the actuation of the casement lock 1 is reduced considerably.

As a rule, the locking members disposed on the operating rods 5, 6 are confronted with a certain resistance when urged for engagement into the corresponding keepers. Now, the higher the speed at which the operating rods 5, 6 are moved, the easier the overcoming of this resistance. Under these conditions, the action of the shock absorber should preferably become effective after the partial penetration of the locking members into the keepers. Advantageously, a no-load movement of the connecting member 7 should take place before driving the movable piston 19. This no-load stroke 50 is equal to the difference between the height 51 of peripheral groove 49 and the thickness 52 of teeth 53 engaging said peripheral groove 49 and constituting the gripping means 46 of connecting member 7. Thus, the connecting member 7 drives the movable piston 19 of shock absorber 15 only after the operating rods 5, 6 have travelled along a distance or length corresponding to the above-defined no-load partial movement 50.

Of course, the proper operation of shock absorber 15 requires a reliable fluid-tightness between on the one hand the fixed piston 17 and the central bore 18, and on the other hand between the lower portion 23 of movable piston 19 and the bore 20. This requirement is met by the fact that the fixed piston 17 and the lower portion 23 of movable piston 19 comprises at their lower ends 54 and 55, respectively, a peripheral groove in which a gasket or O-ring 56 is inserted.

The main advantage obtained with the present invention consists essentially in the provision of means incorporated in the casement lock for automatically returning the operating rods 5, 6 to their locking position, and of a considerably reduced noise level in operation. On the other hand, by reducing to a substantial degree the recurrent shocks applied to the component elements of casement lock 1, the useful life of the device is extended considerably.

What is claimed is:

1. A casement lock comprising:

(a) a plurality of operating rods adapted to be positioned in a locking position;

(b) means for actuating at least one of said plurality of operating rods to move with a velocity into a locking position operably associated with said plurality of operating rods;

(c) resilient means for urging at least one of said operating rods to the locking position;

(d) a casing housing said means for actuating;

(e) damping means for reducing said velocity of said at least one of said plurality of operating rods during movement to the locking position, said damping means comprises a double-acting shock absorber having a fixed piston slidable in a central bore of a movable piston, the movable piston being slidable in a bore of a cylindrical body, the cylindrical body being rigidly connected to said casing, and said movable piston being coupled to said operating rods.

2. Casement lock according to claim 1, said movable piston comprising upper and lower portions axially aligned with each other, said central bore being formed in the upper portion of said movable piston said lower portion having a cylindrical configuration of a diameter slightly inferior to the diameter of said bore, and sliding in said bore, said lower portion further comprising means enabling a fluid communication between said central bore and said bore of said cylindrical body to permit the flow of fluid therebetween.

3. Casement lock according to claim 1, said movable piston comprising an upper portion and lower portion, said shock absorber comprising communication means permitting a fluid flow between said central bore and said bore of said cylindrical body, said communication means comprising a throttling passage formed in said lower portion of said movable piston and opening on the one hand into said central bore of said upper portion and on the other hand in to said bore of said cylindrical body, said throttling passage being provided at its lower end an opening into said bore of said cylindrical body with a peripheral shoulder forming a throttling orifice.

4. Casement lock according to claim 1, wherein said movable piston is formed iwth a central bore having a diameter substantially equal to the diameter of the corresponding bore of said cylindrical body.

5. Casement lock according to claim 1, wherein said fixed piston is provided, at its upper end, with flange cooperating with gripping means fixed to said casing and adapted to hold said fixed piston with respect to said casing.

6. Casement lock according to claim 1, wherein said cylindrical body includes on its outer surface and at its ends a peripheral groove engageable by holding means fixed to said casing 7. Casement lock according to claim 1, wherein said movable piston includes an upper portion and a lower portion, said upper portion comprising a peripheral groove cooperating with gripping means fixed to a connecting member or to one of said operating rods.

8. Casement lock according to claim 1, said movable piston cooperating via gripping means with said operating rods or with a connecting member connected thereto, said operating rods being urged by resilient means to their locking position and adapted to move under no-load conditions before positively driving said movable piston.

* * * * *